United States Patent [19]

Jeschke

[11] Patent Number: 4,573,407

[45] Date of Patent: Mar. 4, 1986

[54] INKING MECHANISM FOR OFFSET PRINTING MACHINES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 437,741

[22] Filed: Oct. 29, 1982

[30] Foreign Application Priority Data

Oct. 31, 1981 [DE] Fed. Rep. of Germany ..... 3143314
Sep. 3, 1982 [DE] Fed. Rep. of Germany ..... 3232780

[51] Int. Cl.[4] ..... B41F 7/26; B41F 31/00; B41L 25/14

[52] U.S. Cl. ..... 101/148; 101/349

[58] Field of Search ..... 101/148, 147, 349, 350, 101/351, 352, 353, 363

[56] References Cited

U.S. PATENT DOCUMENTS

| | | | |
|---|---|---|---|
| 3,203,346 | 8/1965 | Norton et al. | 101/217 |
| 3,911,815 | 10/1975 | Banfer | 101/148 |
| 4,127,067 | 11/1978 | Dahlgren | 101/148 X |
| 4,211,167 | 7/1980 | Corse | 101/148 |
| 4,233,898 | 11/1980 | Dahlgren | 101/363 X |

*Primary Examiner*—J. Reed Fisher
*Attorney, Agent, or Firm*—Herbert L. Lerner; Laurence A. Greenberg

[57] ABSTRACT

Inking unit for an offset printing machine with a plate cylinder which includes an ink applicator roll with an elastic surface cooperatively engaging the plate cylinder for delivering ink to the plate cylinder, an ink feeding system and an inking cylinder cooperating with the ink feeding system for receiving ink therefrom and cooperatively engaging the ink applicator roll so as to feed the ink in a continuous film thereto, the ink applicator roll having a diameter approximately equal to the diameter of the plate cylinder and being located downstream from the inking cylinder in ink feed direction, the ink applicator roll being rotatable in a given direction, and means for transfering dampening medium to the ink applicator roll in the given rotary direction thereof at a location of the ink applicator roll downstream of the location at which the ink applicator roll is in engagement with the inking cylinder and upstream of the location at which the ink applicator roll is in engagement with the plate cylinder.

5 Claims, 6 Drawing Figures

INKING MECHANISM FOR OFFSET PRINTING MACHINES

Figure 1:
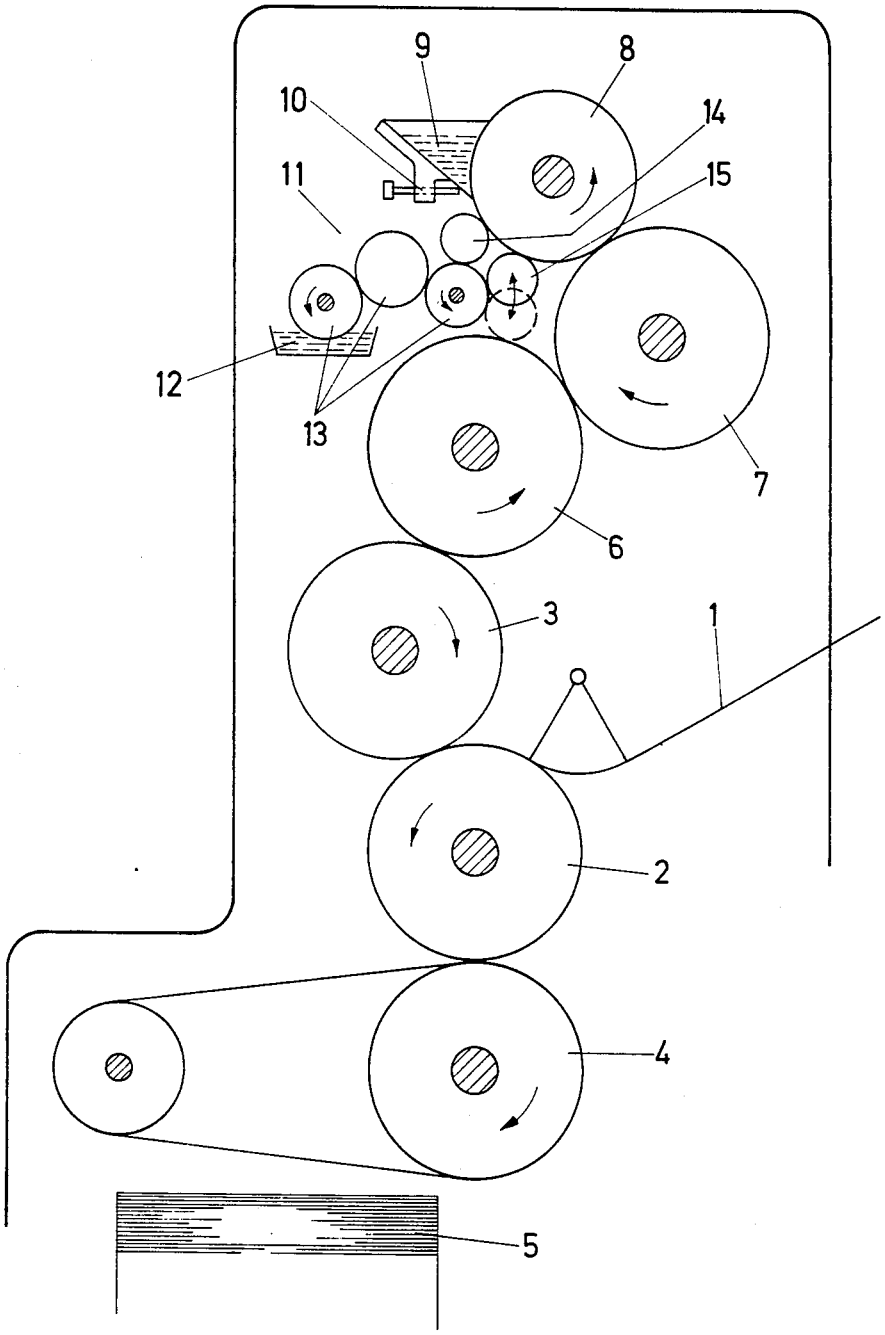

The invention relates to an inking mechanism for offset printing machines.

One of the main criteria in offset printing is the inking of the offset plate without "stencil effects". In conventional offset inking mechanisms, this is achieved with a multiplicity of inking cylinders, at least four ink applicator rolls being required at the plate cylinder. This design is very expensive and cannot prevent a "stencil effect", i.e., a reproduction of faults in the printed form after one revolution of an applicator roll, 100 percent.

In one known inking mechanism (European Patent Application No. 28 420), an ink applicator roll with an elastic surface, the diameter of which is distinctly smaller than that of the plate cylinder, is provided for inking the printing plate. With this ink applicator roll, an inking cylinder is associated which receives the ink to be transferred from a dosing cylinder, so that an ink film of defined thickness is generated over the entire width. For this purpose, the dosing cylinder is driven at a lower speed than the inking cylinder, so that a variation of the ink film thickness can be obtained by the existing slip between the dosing cylinder and the transfer cylinder. In addition, a dampening device is associated in the known design of the applicator roll. The rider rollers which are furthermore associated with the applicator roll and execute a lateral distributing motion, serve the purpose to achieve a more uniform ink distribution, since this additional expense is necessary for eliminating ghosts in the known design.

The disadvantage of the known design is that for inking the printing plate, similarly as in conventional inking mechanisms, a multiplicity of rolls of most varied designs is required, which in part are driven and in addition execute a lateral back and forth motion. Besides a considerable technical effort, it cannot be precluded in an inking mechanism of this design that a "stencil effect" becomes visible in the printed picture, since due to the smaller diameter of the applicator roll, a given point of the surface always touches a different point of the plate cylinder surface. However, to generate on the applicator roll an absolutely uniform ink film prior to inking the printing plate, it would seem that the number of inking mechanism rolls and therefore, of gaps may not be sufficient.

Also so-called "short" inking mechanisms are already known in which the split ink film returning from the plate is completely covered with a large amount of ink and is subsequently built up again by wiping. Among this type of inking mechanisms is the design according to DE-AS No. 23 23 025. The main disadvantage of this design is that the ink applicator roll is subjected to great mechanical wear by the wiping device. The high circumferential velocities of modern offset printing machines lead to high temperatures at the wiping device, regardless of whether a wiper roll or a wiper edge is involved. To produce a uniformly thin film of ink, it is furthermore necessary that the wiping device penetrates into the ink applicator roll. If this leads to damage of the ink applicator roll, also due to deposition of dirt particles at the wiping point, markings in the printed picture are unavoidable.

It is an object of the invention to provide an inking mechanism which, using a small number of ink applicator rolls, works absolutely without "stencil effects" and without wiping at the applicator roll and ensures perfect inking of the printing plate with little wear, so that also printing jobs of top quality can be performed, and in which no "stencil effect" can be produced also by the necessary damping of the offset plate.

The stated problem can be solved by three solutions with modified mechanical design. One solution uses only one ink applicator roll and one inking cylinder, with which an ink dosing device and thereafter, as seen in the direction of rotation thereof, a damping device. In addition, the diameter of the ink applicator roll is designed so that it corresponds to the diameter of the plate cylinder. Thus, this solution of the stated problem requires only two inking mechanism rolls and prevents a "stencil effect" with certainty because the plate cylinder and the ink applicator roll have the same diameter. Arranging the damping device after the ink application has the advantage that the continuous moisture film is applied to a likewise continuous ink film, so that a stencil effect cannot be caused by damping device rolls either.

The arrangement of the damping medium feed depends on whether one or two ink applicator rolls are employed. In any case, the damping medium is supplied from a damping roll system which applies a continuous moisture film on the continuously fed-in ink film. The point of the damping medium application may be located ahead of the point of contact of the inking cylinder with the ink applicator roll, or behind the latter. With only one ink applicator roll for simpler printing systems, for instance, the printing of newspapers, it is preferable to place the point of the damping medium application ahead of the point of contact between the inking cylinder and the ink applicator roll. It is achieved thereby that the moisture film is worked into the ink film at the point of contact.

Another solution has the advantage that the inking is additionally enhanced by two applicator rolls, so that also difficult prints can be controlled simply. It is also ensured by the two applicator rolls which have likewise the diameter of the plate cylinder and by the mutual distance of which it is assured, for a given inking cylinder diameter, that no "stencil effect" occurs. In contrast to first-mentioned solution, the damping device is associated here with an applicator roll, which requires no additional cost as to mechanical design. Thus, also the second mentioned solution of the stated problem represents a simple and cost-effective solution, which meets all quality requirements of a modern machine concept while using only three inking mechanism rolls. It is a further advantage of both solutions that the meter of the printing plate is reduced because only one or two applicator rolls roll on the printing plate.

If two applicator rolls are used, it is advantageous to make the moisture application at the inking applicator roll which is first as seen in the direction of rotation of the plate cylinder after the contact point with the inking cylinder. It is possible and makes sense because with two ink applicator rolls, the damping medium can be worked into the ink at the additional contact points of the plate cylinder, the ink applicator rolls and the inking cyclinder. An additional distributor roll at the first applicator roll as seen in the direction of rotation of the plate cylinder improves the working-in of the damping medium into the ink film of the applicator roll.

A third solution differs from the first-mentioned solution only slightly with respect to the arrangement of the inking cylinder and the applicator roll, the damping device with the inking cylinder, after the application of the ink, one or several distributor rolls which ensure equalization of the ink film. There is no danger of a "stencil effect" because of this, because no ink profile is present on the inking cylinder at this point. The printing result can also be improved by the additional distribution roll with a rough chromium cylinder surface at the applicator roll, because it works the damping medium into the ink film already ahead of the plate cylinder, so that no ink splitting and thereby, no "stencil effect" takes place due to the chromium cylinder surface.

The features of the subclaims relate to advantageous embodiments

Embodiments of the invention are schematically shown in the drawings, where

Figure 1A:
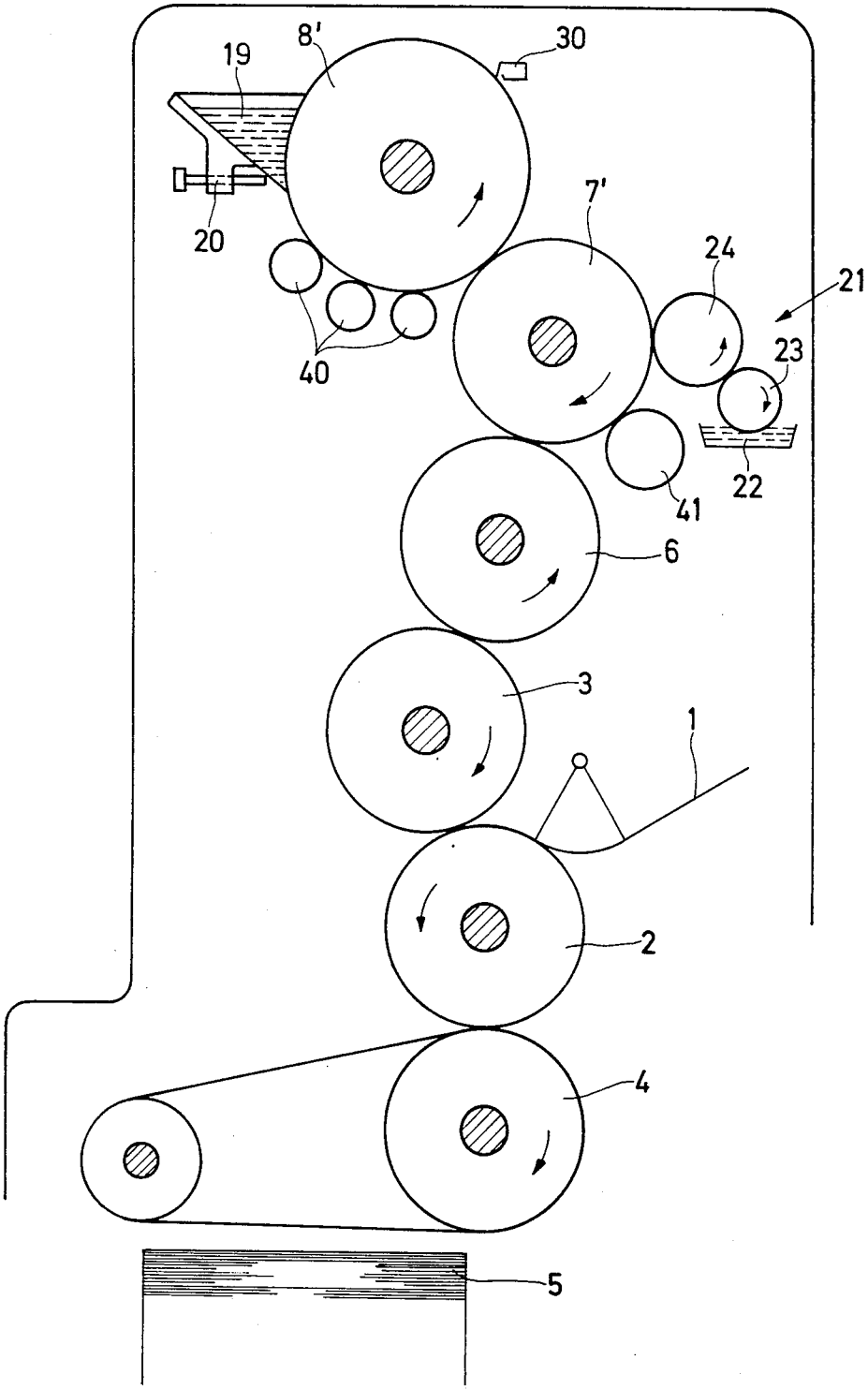
Figure 2:
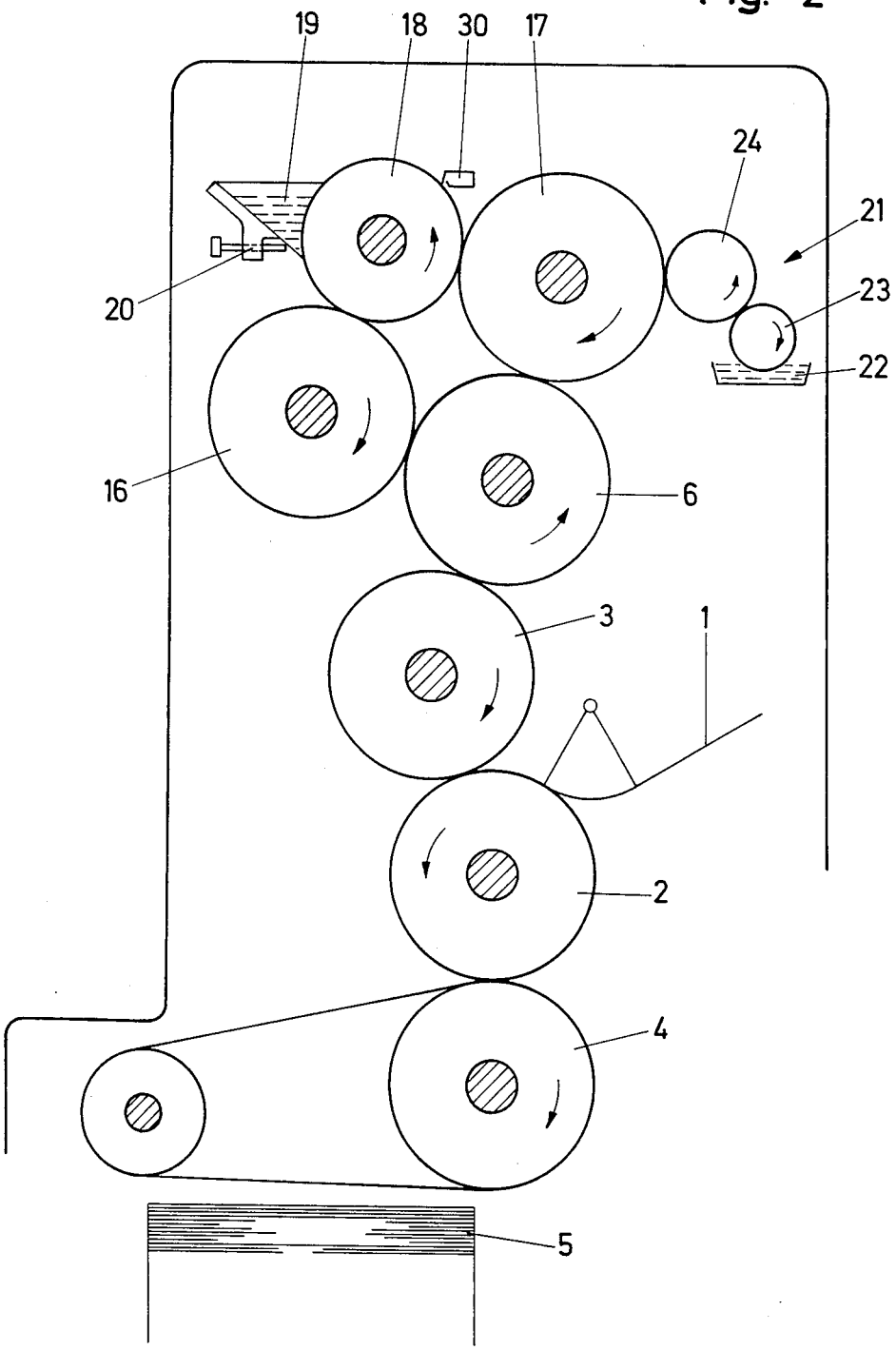

FIG. 1 shows one embodiment of an inking mechanism with an applicator roll according to the invention, FIG. 1*a* shows another embodiment of the invention including an inking mechanism with an applicator roll, FIG. 2 shows a third embodiment of the invention including an inking mechansim with two applicator rolls'

Figure 2A:
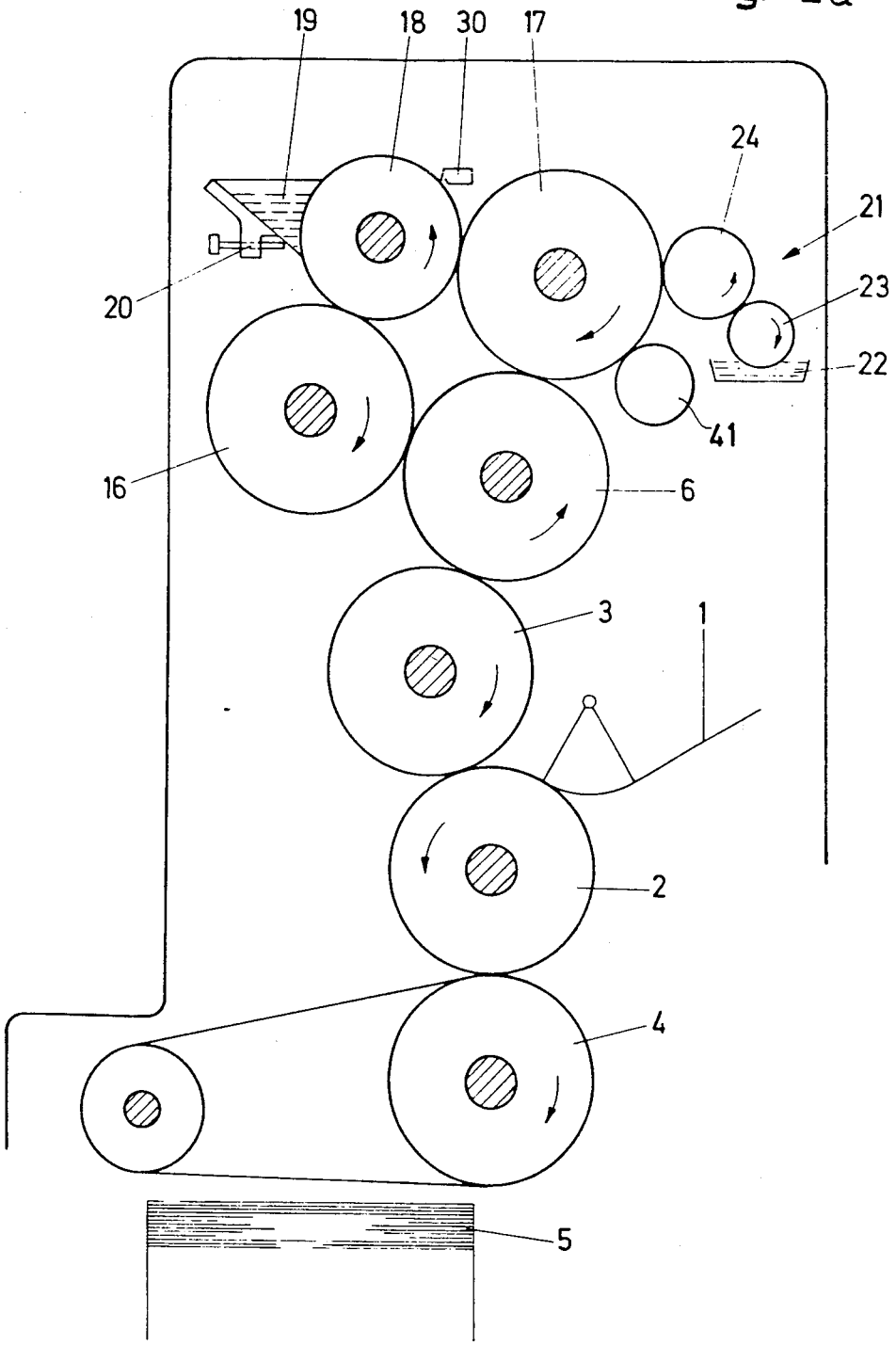
Figure 3:
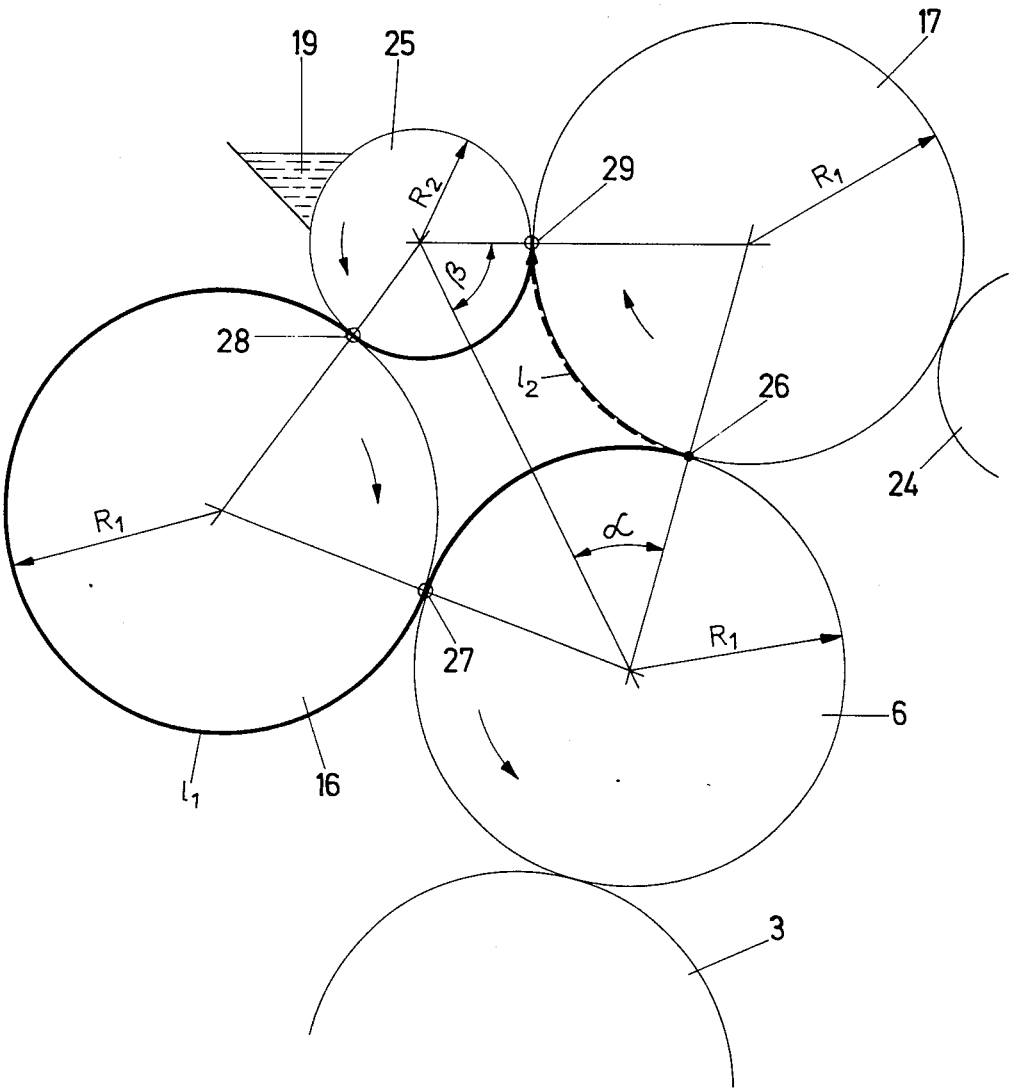
Figure 4:
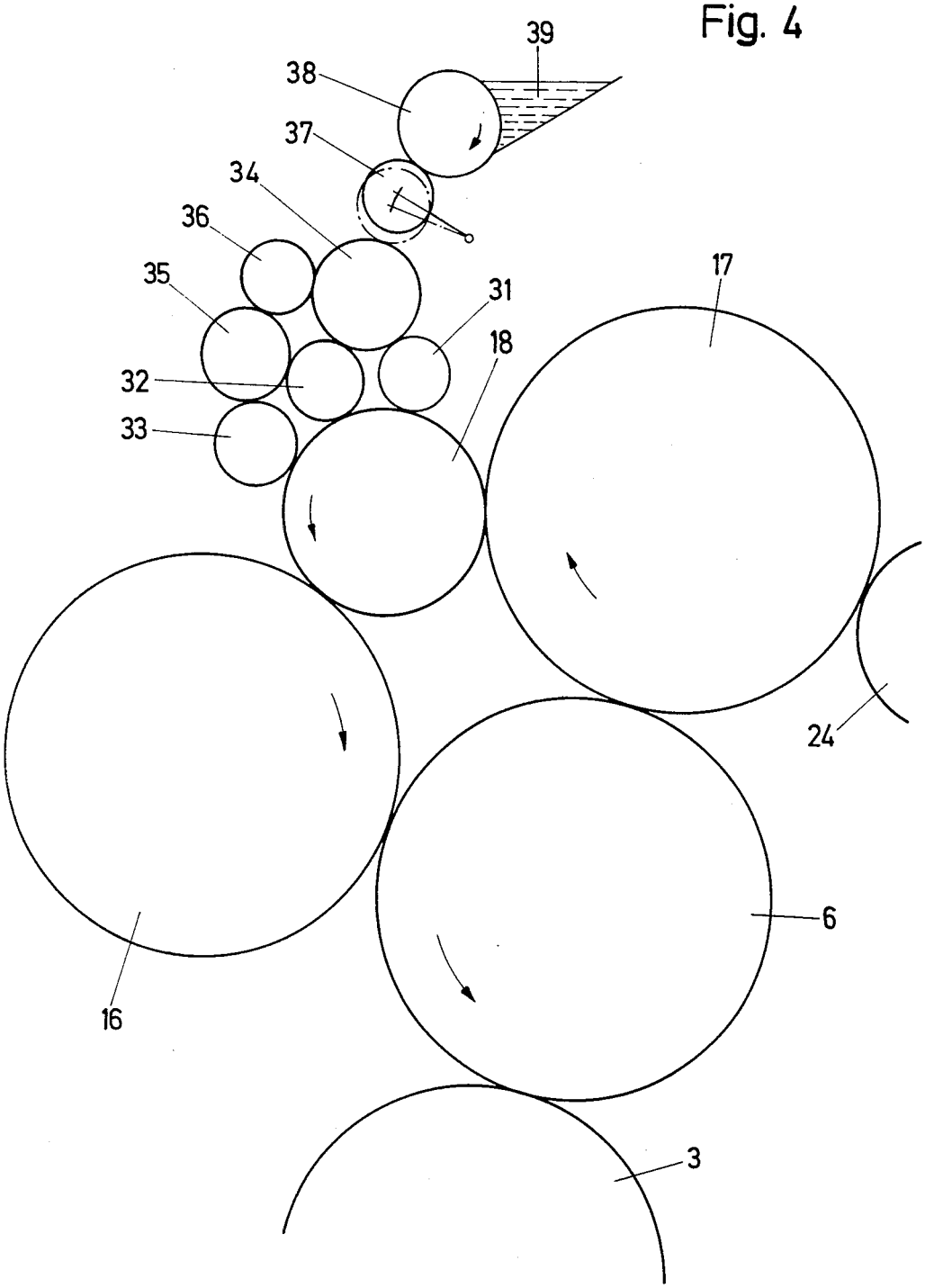

FIG. 2*a* shows a fourth embodiment of the invention including an inking mechanism with two applicator rolls, FIG. 3 is a side view of a roll schematic according to FIG. 2, and FIG. 4 shows an inking mechanism with two applicator rolls and a special ink supply system.

In FIG. 1 an offset printing mechanism for sheet printing is reproduced with a sheet feeder 1, by which the sheets are fed to a printing cylinder 2. On this cylinder they receive their imprint by a rubber cylinder 3. After they are printed, they are transported to the delivery stack 5 by a depositing system 4.

The rubber cylinder 3 cooperates with a plate cylinder 6, with which an ink applicator roll 7 is associated, the diameter of which corresponds approximately to the plate cylinder diameter. The ink applicator roll 7 has an elastic surface and transfers an absolutely uniform ink film of constant thickness to the places to be printed of the printing plate of the plate cylinder 6.

The design of an offset printing mechanism reproduced in FIG. 1*a* differs from FIG. 1 by the arrangement of the ink applicator roll 7' and the inking cylinder 8'. In this embodiment, the dampening device 21 is associated with the ink applicator roll 7', so that the dampening medium is already applied to the existing ink film. As seen in the direction of rotation of the ink applicator roll 7', an additional distribution roll 41 with a chromium cylinder surface is provided after the dampening device 21, which works the damping medium into the ink film. Instead of the damping device, the inking cylinder 8' has one or more distributor rolls 40 which contribute to the equalization of the ink film, so that also minimal disturbances of the ink profile are eliminated.

With the ink applicator roll 7, an inking cylinder 8 is associated, the diameter of which was chosen smaller. With the inking cylinder 8 is associated an ink box or duct 9 with an ink dosing device 10, which will not be explained in detail, and makes it possible to regulate the thickness of the ink film on the inking cylinder 8. To the inking cylinder 8 is further associated a damping device 11 which transfers the dampening medium from a moisture container 12 via the damping rolls 13, 14 and 15 to the inking cylinder 8. In order to provide the printing plate on the plate cylinder 6 with dampening medium faster at the start of production, the moisture applicator roll 15 is designed so that it can be removed from the inking cylinder 8 about the last dampening roll 13 and can be set against the plate cylinder 6, so that the latter is dampened for a short time directly.

The embodiment according to FIG. 2 differs in that two ink applicator rolls 16, 17 are in contact with the plate cylinder 6. With the latter, in turn, is associated an inking cylinder 18, to which the ink is fed from an ink box 19 with an ink dosing device 20. In the embodiment example shown, a dampening device 21 which consists of a moisture container 22, a damping roll 23 and a moisture applicator roll, is associated with the ink applicator roll 17. With the inking cylinder 18 may be associated, for instance, if there is a large accumulation of paper dust, a device 30 which removes the residual ink profile.

If according to FIG. 2, the diameters of the ink applicator rolls 16, 17 and the diameter of the inking cylinder 18 are laid out to be equal to the plate cylinder diameter, it is sufficient to arrange the two ink applicator rolls 16, 17 at an angle of 90° to each other, to prevent a "stencil effect" with certainty. Equally well, however, the diameter of the inking cylinder according to FIGS. 2 and 3 can also be laid out smaller.

If a fault on the center line between the plate cylinder 6 and the ink applicator roll 17 at 26 is assumed, it must travel the length of arc $l_1$ at the circumference of the plate cylinder 6 to the point of contact 28 to the inking cylinder 25 and at its circumference to the point of contact 29 to the ink applicator roll 17, where this length must be equal to the length of arc $l_2$ from the point of contact 26 between the plate cylinder 6 and the ink applicator roll 17 to the point of contact 29 between the ink applicator roll 17 and the inking cylinder 25 plus the circumference of an ink applicator roll. In this case, the fault will coincide at the point of contact 26 between the ink applicator roll 17 and the inking cylinder 25 with the fault, which has traveled the arc length according to $l_1$, however, shifted by exactly one revolution. The corresponding angles can be calculated. If, for instance, $R_2$ is chosen one-half of $R_1$, the angles $\alpha = 42.24°$ and $\beta = 63.67°$ are obtained. Within the scope of possible designs, the diameter of the inking cylinder 25 can therefore be determined at will.

In the embodiment example shown according to FIGS. 1 to 3, the inking cylinders 8, 8', 18 and 25 are made with a hard, inelastic surface. The ink applicator rolls 7, 7', 16 and 17 are provided with an elastic surface and are normally not driven separately. It is sufficient here that the ink applicator rolls have the plate cylinder diameter only approximately, since the "stencil effect" is visible only with a fault displacement of about 3 mm or more. The applicator rolls can therefore be made with a diameter thicker by about 1 mm than the plate cylinder, for grinding off later. A further advantage of the small diameter differences is that a fault, for instance at the cylinder surface of an applicator roll, travels a small amount at the circumference and thereby does not lead to point-wise damage to the printing plate.

The embodiment shown in FIG. 2*a* differs from FIG. 2 in that at the ink applicator roll 17, as seen in the direction of rotoation thereof, after the damping device 21 and ahead of the transfer point to the plate cylinder 6, a distributor roll 41 is likewise provided, the chromium cylinder surface of which leads in the manner described to an improvement of the printing result without the danger of a "stencil effect".

If a separate drive for the ink applicator rolls is provided, these can be covered in a manner known per se with a rubber cloth, where the cylinder channel for the stretching device of the rubber cloth meet the channel for the plate clamping device at the plate cylinder 6.

Instead of the ink feeding systems shown in FIGS. 1 to 3, consisting of the ink box 9, 19 and the ink dosing device 10, 20 which continuously build up an ink film by wiping, an ink feeding system with a larger number of rolls which equal a conventional inking mechanism part (FIG. 4) can be employed for difficult work with special inks or paper qualities. These can be associated without difficulty with the inking cylinder 18 instead of the ink box 9. This may involve, for instance, three inking cylinders 31, 32, 33 which cooperate with two distributor rolls 34, 35, with which in turn a transfer roll 36 is associated where the ink is fed to the distributor roll 34 via a lifting roll 37 from an ink box roll 38, with which an ink box 39 is associated. The advantages of the subject of the invention are preserved also in this embodiment, for, with the plate cylinder 6, likewise only one or two applicator rolls 7 or 16, 17 is associated which ink without causing "stencil effects" and save the printing plate in the process by their smaller number of rolling contacts.

I claim:

1. Inking unit for an offset printing machine with a plate cylinder comprising at most two ink applicator rolls with an elastic surface cooperatively engaging the plate cylinder for delivering ink to the plate cylinder, an ink feeding system and an inking cylinder cooperating with said ink feeding system for receiving ink therefrom and cooperatively engaging said ink applicator rolls so as to feed the ink in a continuous film thereto, said ink applicator rolls having a diameter approximately equal to the diameter of the plate cylinder and being located downstream from said inking cylinder in ink feeding direction, said ink applicator rolls being rotatable in a given direction, the sum of an arc length on the periphery of the plate cylinder, as seen in direction of rotation of the plate cylinder, from a location at which the plate cylinder is in engagement with a first one of said ink applicator rolls to a location at which the plate cylinder is in engagement with the second one of said ink applicator rolls, an arc length on the periphery of said second ink applicator roll, as seen in direction of rotation of said second ink applicator roll, from said last-mentioned location to a location at which said second ink applicator roll is in engagement with said inking cylinder, and an arc length on the periphery of said inking cylinder, as seen in direction of rotation of said inking cylinder, from said engagement location of said second ink applicator roll and said inking cylinder to the mutual engagement location of said inking cylinder and said first ink applicator roll being equal to an arc length on the periphery of said first ink applicator roll, as seen in direction of rotation of said first ink applicator roll, from said location at which the plate cylinder is in engagement with said first ink applicator roll to said location at which said first ink applicator roll is in engagement with said inking cylinder, plus the circumferential length of one of said first and said second ink applicator rolls, and means for transfering dampening medium to said first ink applicator roll in said direction of rotation of said first ink applicator roll at a location downstream of said location at which said first applicator roll is in engagement with said inking cylinder and upstream of said location at which said first ink applicator roll is in engagement with the plate cylinder.

2. Inking unit according to claim 1 including a distributor roll (41) with a rough chromium cylindrical surface engaging said first ink applicator roll (17) upstream of the plate cylinder (6) as seen in the direction of rotation of said first ink applicator roll.

3. Inking unit according to claim 1 wherein the inking cylinder has a hard inelastic surface.

4. Inking unit according to claim 1 wherein said first and second ink applicator rolls are covered like printing unit cylinders with a rubber cloth and having clamping devices for clamping said rubber cloth in a respective cylinder channel, said ink applicator rolls being driven at the same speed as the plate cylinder.

5. Inking unit according to claim 1 wherein said ink feeding system comprises an ink duct and an ink dosing device operatively associated with said inking cylinder.

* * * * *